United States Patent [19]

Morishima

[11] Patent Number: 4,480,782

[45] Date of Patent: Nov. 6, 1984

[54] PUNCH PRESS DIE ASSEMBLY WITH PUNCH SELECTING MECHANISM

[75] Inventor: Satomi Morishima, Toyota, Japan

[73] Assignee: Toyota Jidosha Kabushiki Kaisha, Toyota, Japan

[21] Appl. No.: 454,676

[22] Filed: Dec. 30, 1982

[51] Int. Cl.[3] ..... B26F 1/04

[52] U.S. Cl. ..... 234/98; 83/571

[58] Field of Search ..... 83/571; 234/98, 97, 234/101, 78

[56] References Cited

U.S. PATENT DOCUMENTS

| | | | |
|---|---|---|---|
| 577,585 | 2/1897 | Royle | 234/98 X |
| 1,313,699 | 8/1919 | Kavanagh | 234/98 X |
| 2,836,244 | 5/1958 | Dodge | 234/98 |
| 3,733,466 | 5/1973 | Krumrey | 234/98 X |

FOREIGN PATENT DOCUMENTS 57-106526 of 1982 Japan .

*Primary Examiner*—James M. Meister

*Attorney, Agent, or Firm*—Cushman, Darby & Cushman

[57] ABSTRACT

A simplified punch press die assembly with a punch selecting mechanism, wherein vertically movable punches are each loaded with a downwardly biasing spring, and a punch selecting plate with escape holes in predetermined positions is mounted on the upper ends of the punches slidably in the direction perpendicular to the axis of the punches to select one of predetermined punching patterns with different combinations of punching holes.

7 Claims, 6 Drawing Figures

| PUNCHING PATTERN | HOLE NUMBER | | | | | | | | | | |
|---|---|---|---|---|---|---|---|---|---|---|---|
| | 18a | 18b | 18c | 18d | 18e | 18f | 18g | 18h | 18i | 18j | 18k |
| a | | ○ | | | ○ | | | | ○ | ○ | |
| b | | ○ | ○ | | | ○ | | | | ○ | |
| c | ○ | ○ | | ○ | | | | | | ○ | |
| d | ○ | | | | | | ○ | ○ | | | |
| e | | | | | ○ | | | | ○ | | |
| f | ○ | | | | | ○ | ○ | ○ | | | ○ |

PUNCH PRESS DIE ASSEMBLY WITH PUNCH SELECTING MECHANISM

BACKGROUND OF THE INVENTION

1. Field of the Invention

This invention relates to punch press dies, and more particularly to a punch press die assembly capable of selectively changing the positions of punching holes in a number of different patterns.

2. Description of the Prior Art

The means which are generally resorted to for forming perforations in a steel plate or other sheetlike material include the boring by drills and the punching by presses.

In the boring operation by a drill, there is a possibility of the operator getting hurt due to the necessity for manually removing the chips which remain on the bored work. Besides, since there is a possibility of failure which might have been caused by abrasive wear of a drilling tool or by a damage due to fluttering of the drilling tool, it is necessitated to confirm whether the holes have been bored or not after each boring operation, which results in requiring superfluous operation. Another problem involved in the drilling operation is the difficulty of drilling holes in close positions for the necessity of securing spaces for holding the drills. In such a case, there have to be provided a plural number of drilling machines, which naturally increases the equipment cost.

On the other hand, the punch presses which are capable of forming a greater number of holes by a single downward punching motion of the upper die have advantages over the drills in terms of savings in time and cost, but the punch presses have a problem that the punching positions are invariably determined by the positions of the punches which are mounted on the upper die. Namely, it has been difficult to change the positions of holes to be punched in each punching operation or to punch holes selectively.

SUMMARY OF THE INVENTION

It is an object of the present invention to solve the above-mentioned problems, more particularly, to provide a simplified punching press die assembly capable of punching holes in selected positions by the use of single die adopting the corresponding pattern from among one group of plural patterns with specified combination of holes.

It is another object of the present invention to provide a simplified punching press die assembly applicable to punching holes according to the other group of plural patterns through easily changing the punch selecting plate explained below.

It is a further object of the present invention to provide a simplified punching press die assembly which has no restrictions on the pitch of holes to be punched and which is capable of punching holes in close positions.

It is still another object of the present invention to provide a simplified punching press die assembly which is capable of performing the selective punching operation smoothly.

It is a further object of the present invention to provide a simplified punching press die assembly of simple and compact construction.

In order to achieve the above-mentioned objectives, the present invention provides a simplified punching press die assembly with a punch selecting mechanism, comprising: a punching die for mounting a work to be punched; a vertically movable upper die holder located over the punching die; a number of punches supported on the lower side of the upper die holder and vertically movable with and relative to the upper die holder; a spring urging the punch downwardly relative to the upper die holder; a punch selecting plate located on the upper ends of the punches and slidable along the upper die holder in the direction perpendicular to the axes of the punches; and a plural number of escape holes provided in the punch selecting plate and engageable with the unselected punches to render them inoperative.

With the foregoing construction, it is possible to punch holes easily in a number of different patterns of one group by the use of the same press die by sliding the same punch selecting plate in the direction perpendicular to the axes of the punches. The punch selecting plate can be easily replaced when it is desired to punch holes in a pattern which is not selectable by that punch selecting plate. Since there is no need for securing the tool-holding spaces as required in the drilling operation, the holes can be formed at close positions by a single die assembly with almost no restriction on the pitch of holes to be punched. In addition, the punches are urged downwardly, the punch selecting plate can be moved to a selected position smoothly without being hindered by sliding resistance between the punches and the punch selecting plate. The punching operations in different patterns can be achieved not by a plural number of punch presses but by a single punch press die, so that it becomes possible to reduce the floor space of the equipments as a whole.

BRIEF DESCRIPTION OF THE DRAWINGS

The above and other objects, features and advantages of the invention will become apparent and more readily appreciated from the following detailed description of a preferred exemplary embodiment of the invention, taken in conjunction with the accompanying drawings, in which.

DETAILED DESCRIPTION OF THE PREFERRED EMBODIMENTS

Figure 1:
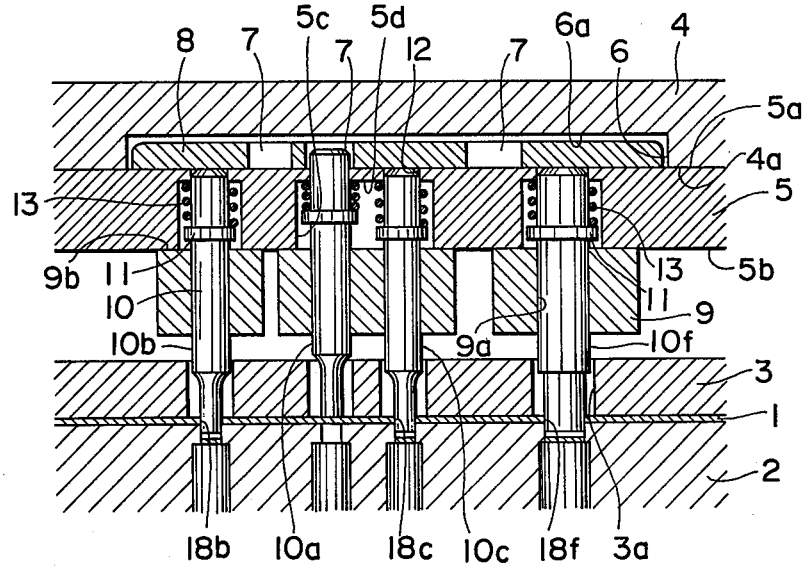
FIG. 1 is a fragmentary vertical section of a simplified punch press die assembly with a punch selecting mechanism according to the present invention.
Figure 2:
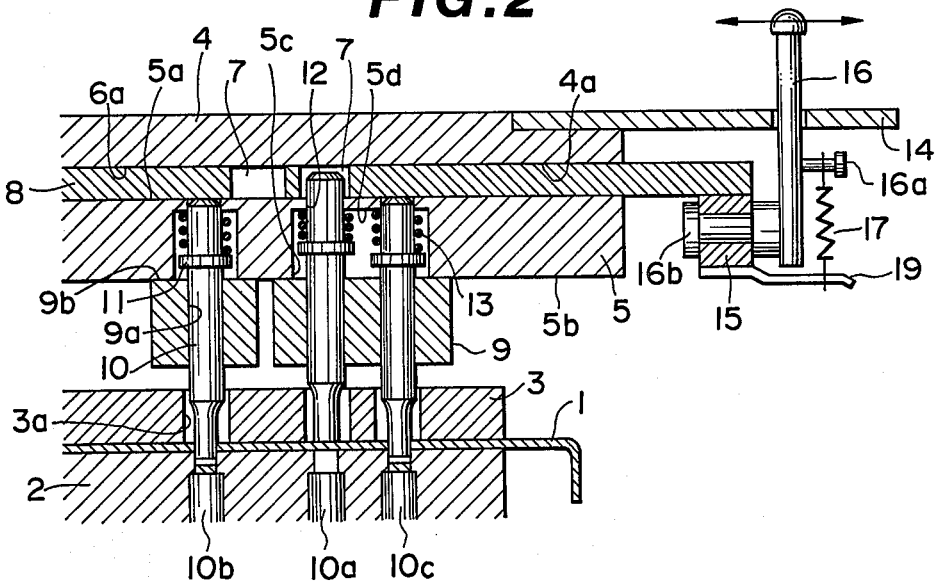
FIG. 2 is a section showing the die assembly of FIG. 1 to which the selecting mechanism is connected.

Referring to the drawings, FIG. 1 shows in section the punches and associated component parts of the simplified punch press die assembly with the punch selecting mechanism according to the present invention, and FIG. 2 shows the same assembly along with an operating lever of a punch selecting plate.

In these figures, a work 1 which is to be punched is mounted on a punching die 2 and fixedly gripped in position by a pad 3 with holes 3*a* which are located immediately above the punching die 2. Located over the punching die 2 is an upper die holder 4 which is movable vertically toward and away from the punching die 2 and provided with a punch plate 5 on its lower side 4*a*. Formed on the lower side 4*a* of the upper die holder 4 is a recess 6, receiving a punch selector plate 8 between the bottom surface 6*a* of the recess 6 and the upper surface 5*a* of the punch plate 5. The punch selecting plate 8 is provided with a plural number of escape holes 7 to be positioned over the unselected ones of the punches 10, which are not required to punch the work 1 in a selected punching pattern. The punch selecting plate 8 is inserted between the bottom surface 6*a* of the groove 6 and the upper surface 5*a* of the punch plate 5 slidably in the direction perpendicular to the axes of the punches 10.

The punches 10 are slidably fitted in a punch holder 9 which is fixed on the lower side 5*a* of the punch plate 5, and provided with flanges 11 of an increased diameter above the punch holder 9. The inside diameter of the punch-receiving holes 9*a* in the punch holder 9 is smaller than the outside diameter of the flanges 11. Therefore, when the punches 10 are moved downward relative to the punch holder 9, the flanges 11 are abutted against the upper surface 9*b* of the punch holder 9, preventing the punches 10 from being extracted completely out of the punch plate 5.

On the lower side, the punch plate 5 is provided with a groove 5*c* which is in turn provided with bores 12 in its bottom surface 5*d* for receiving upper ends of punches 10. A spring 13 is interposed between the bottom surface 5*d* of the groove 5*c* and the flange 11 of the punch 10 thereby urging the punch 10 downward relative to the upper die holder 4. In the particular embodiment shown, the spring 13 consists of a compressed coil spring.

Figure 4:
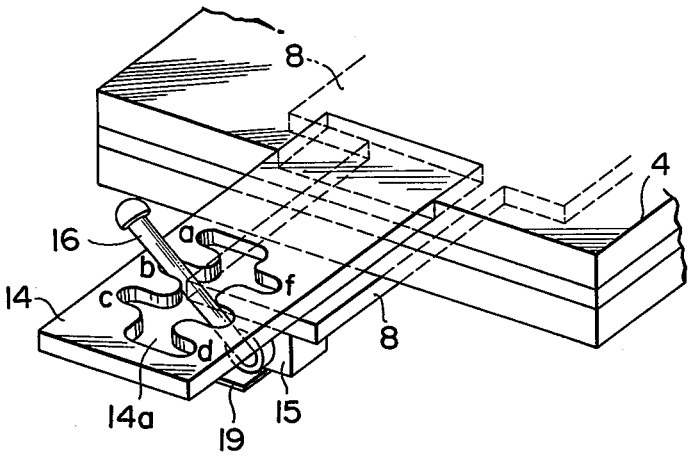
FIG. 4 is a fragmentary perspective view of the selecting mechanism shown in FIG. 2.
Figure 5:
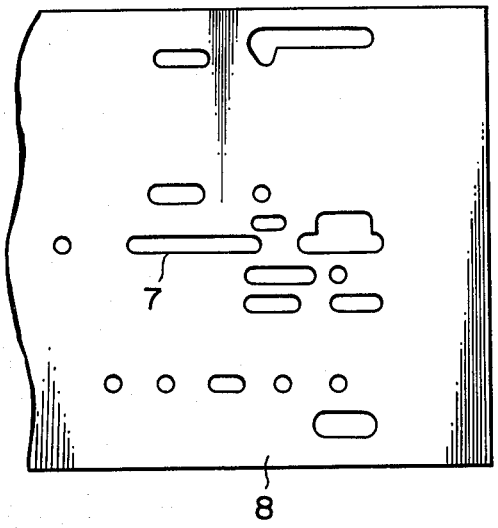
FIG. 5 is a fragmentary plan view of a punch selecting plate employed in the present invention.
Figure 6:
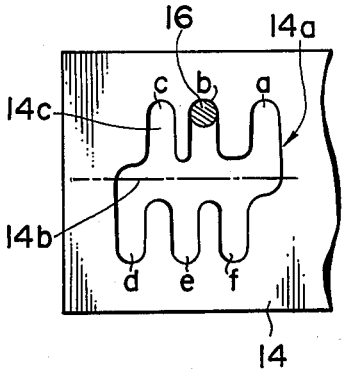
FIG. 6 is a fragmentary plan view of a selector member employed in the present invention.

As shown in FIGS. 2 and 4, a selector plate 14 which is mounted on the upper die holder 4 is provided with an operating lever 16 which is linked to the punch selecting plate 8 through an operating lever retainer 15. The operating lever 16 is received in a punched aperture 14*a* of the selector plate 14. The aperture 14*a* has, as shown particularly in FIG. 6, a first groove 14*b* extending in the direction of sliding movement of the punch selecting plate 8, and a plural number of second grooves 14*c* branched sideward from the first groove 14*b* at staggered positions and defining positions a to f to which the operating lever 16 is shiftable to change its position relative to the selector plate 14. As the position of the operating lever 16 relative to the selector plate 14 is changed, the selector plate 14 and the punch selecting plate 8 are moved at right angles with the punches 10 to change the combination of non-operating punches 10. FIG. 6 shows the operating lever 16 as held in the position b.

As illustrated particularly in FIG. 2, the operating lever 16 is pivotally connected to the punch selecting plate 8 through the lever retainer 15. A spring 17 is tensioned between a first spring bracket 16*a* provided on the body of the operating lever 16 and a second spring bracket 19 which is provided on the punch selecting plate 8 through the lever retainer 15 at a position on opposite side of the fulcrum point 16*b* of the operating lever 16. The tension spring 17 serves to stabilize the engagement of the operating lever 16 with the second grooves 14*c*. Namely, the lever 16 which is in engagement with the second groove 14*c* at the position b in FIG. 6 needs to be rocked against the force of the tension spring 17 to shift it, for example, to the position a, so that the lever 16 is in the most stable state when it is in the selected position.

FIG. 4 shows in perspective view the operating lever 16 as held in the position b of the selector plate 14. As the operating lever 16 is shifted to that position of the selector plate 14, the punch selecting plate 8 is moved into a predetermined position in which, for example, the head portion of only one punch 10*a* among a number of punches 10*a* to 10*f* in FIG. 1 is fitted in the escape hole 7 in the punch selecting plate 8.

Now, the description is directed to the operation of the simplified punching press die assembly with the selective punching mechanism according to the invention.

Figure 3:
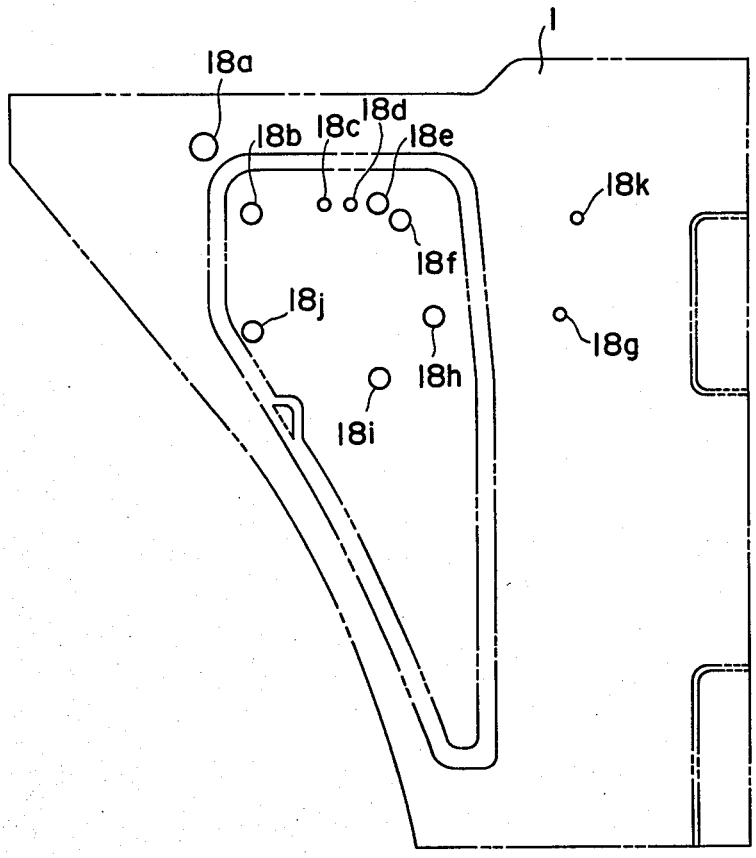
FIG. 3 is a table showing a number of different punching patterns in relation with positions of punching holes on a work.

Referring the FIG. 3, there is shown an example of the relationship between the position of the operating lever 16 in the second grooves of the selector plate 14 and the combinations of the holes 18 to be punched into the work 1. By selecting one of the punching patterns a to f in the table of FIG. 3, the punch selecting plate 8 is moved to a corresponding position to punch the holes at the positions with a mark "0" among a plural number of predetermined punching positions 18*a* to 18*k*. In this instance, the lever positions a to f of FIG. 6 correspond to the punching patterns a to f of FIG. 3, respectively. For example, if the lever 16 is pushed into the position b of the grooves 14*c* in the selector plate 14 in FIG. 6, the pattern b in the table of FIG. 3 is selected to punch the holes 18*b*, 18*c*, 18*f* and 18*j*. Namely, the punches 10 which are positioned over the unselected ones 18*a*, 18*d*, 18*e*, 18*g*, 18*h*, 18*i* and 18*k* of the holes 18 are rendered inoperative by engagement with the escape holes 7 in the punch selecting plate 8 which are located immediately above the unselected punches.

In this state, if the upper die holder 4 is lowered, the punches 10 are lowered therewith, with the lower ends of the punches 10 being slidingly descended through the punch holes 3*a* and driven toward the work 1. At this time, the punches 10 which have no escape hole 7 on upper side (the punches 10*b*, 10*c* and 10*f* in the case of FIG. 1) are pressed against the work 1 by the punch selecting plate 8 to punch the holes 18*b*, 18*c* and 18*f*. On the other hand, the punches 10 which has an escape hole 7 on the upper side (the punch 10*a* in FIG. 1) is pushed back upward against the action of the spring 13 by the force of the work 1 and its upper end is retracted into the escape hole 7 without punching a hole in the work 1 by its lower end. Although the foregoing description explains the operation for the punching pattern b, the unselected punches with the escape holes 7 on the upper side are rendered to be inoperative similarly in the operations for the other punching patterns a and c to f, pressing only the selected punches 10 to punch the holes 18 in a selected pattern.

In this manner, the combination of the unselected punches is varied depending upon the selection of one of the punching patterns a to f, and the punching pattern can be easily changed simply by shifting the operating lever 16 to a desired position on the selector plate 14. In case where it becomes necessary to punch holes in a pattern which is not found in one group of patterns which can be punched adopting one selecting plate, due to an alteration in design or for other reason, the punching operation of the different pattern belonging to the other group is feasible simply by changing the selecting plate 8 alone.

As clear from the foregoing description, the simplified punch press die with the above-described punch selecting mechanism according to the present invention has a number of advantageous effects as follows.

Firstly, it becomes possible to cut the time and cost of the punching operation by the use of a punch press die which is capable of selectively punching holes in a number of different patterns. In this instance, it is not necessary to remove the chips after each operation or to check for damages of the tool or punched holes as in the drilling operation, so that the operation involves a reduced number of steps. In addition, for boring holes at close positions by the drilling operation, it is necessary to employ a number of drilling machines due to the difficulty of holding the drilling tools at close positions, although it can be performed by the use of a single die and a single punch selecting plate. The use of the punch selecting plate which is capable of altering the punching pattern also contributes to make the machine compact.

Further, with the transversely slidable punch selecting plate, it is possible to punch holes in a number of different patterns of one group by the use of the same component part, and the punching patterns can be completely altered simply by replacement of the punch selector plate alone.

Furthermore, since the punches are urged downward in the respective positions, the punch selecting plate can be moved smoothly in the direction perpendicular to the axes of the punches, permitting to perform the shifting operation in an almost resistancefree state.

What is claimed is:

1. A simplified punch press die assembly with a punch selecting mechanism, comprising:

a punching die for mounting a work to be punched;

a vertically movable upper die holder located over said punching die;

a plurality of punches supported on the lower side of said upper die holder and vertically movable with and relative to said upper die holder;

a plurality of springs urging said punches downwardly relative to said upper die holder;

a punch selecting plate located on the upper ends of said punches and switchable to one of a plurality of predetermined positions by sliding movements perpendicular to the axes of said punches for selecting one of predetermined punching patterns;

a plurality of escape holes provided in said punch selecting plate and engageable with unselected ones of said punches to render said unselected punches inoperative by positioning said escape holes over said unselected punches;

an operating lever linked to said punch selecting plate; and a selector plate mounted on said upper die holder defining a punched aperture for engagement with said operating lever, said punched aperture having a first groove extending in the direction of movements of said punch selecting plate and a plurality of second grooves branching sideward from said first groove at staggered positions along the length thereof, said operating lever being shiftable through said first groove for engagement with one of said second grooves thereby to change the position of said punch selecting plate relative to said selector plate and to change the combination of said unselected punches.

2. A simplified punch press die assembly with a punch selecting mechanism as set forth in claim 1, wherein said operating lever is pivotally connected to said punch selecting plate and stably held in engagement with one of said second grooves by a spring tension between a first spring bracket on said operating lever and a second spring bracket on said punch selecting plate located on opposite sides of a fulcrum point of said operating lever.

3. A simplified punch press die assembly with a punch selecting mechanism as set forth in claim 1, wherein said upper die holder is formed with a recess on the lower side thereof and has a punch plate attached to said lower side, slidably holding said punch selecting plate between the bottom surface of said recess and the upper surface of said punch plate.

4. A simplified punch press die assembly with a punch selecting mechanism as set forth in claim 3, a spring is interposed between the bottom surface of a recess formed on the lower side of a spring-accommodating recess and a flange of an increased diameter provided on each one of said punches.

5. A simplified punch press die assembly with a punch selecting mechanism as set forth in claim 4, wherein said spring is a compressed coil spring.

6. A simplified punch press die assembly with a punch selecting mechanism as set forth in claim 4, wherein a punch holder is attached to the lower side of said punch plate to prevent extraction of said punches from said punch plate by engagement with said flanges of punches when said punches are moved downward relative to said upper die holder, said punches being slidably engaged with said punch holder.

7. A simplified punch press die assembly with a punch selecting mechanism as set forth in claim 4, wherein a pad is provided immediately over said punching die, said pad being provided with holes for slidably receiving the lower ends of said punches, said work being securely gripped between said punching die and said pad.

* * * * *